US008613314B2

(12) United States Patent
Garcia-Lopez De Victoria et al.

(10) Patent No.: US 8,613,314 B2
(45) Date of Patent: Dec. 24, 2013

(54) METHODS TO ENHANCE THE PRODUCTIVITY OF A WELL

(75) Inventors: Marieliz Garcia-Lopez De Victoria, Sugar Land, TX (US); Carlos Abad, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 541 days.

(21) Appl. No.: 12/941,210

(22) Filed: Nov. 8, 2010

(65) Prior Publication Data

US 2012/0111565 A1 May 10, 2012

(51) Int. Cl.
*E21B 43/267* (2006.01)

(52) U.S. Cl.
USPC ..... 166/250.1; 166/250.01; 166/280.1; 166/280.2; 507/924

(58) Field of Classification Search
None
See application file for complete search history.

(56) References Cited

U.S. PATENT DOCUMENTS

| | | | | |
|---|---|---|---|---|
| 3,405,762 | A * | 10/1968 | Terwilliger | 166/308.2 |
| 4,554,082 | A | 11/1985 | Holtmyer et al. | |
| 6,239,183 | B1 | 5/2001 | Farmer et al. | |
| 6,379,865 | B1 | 4/2002 | Mao et al. | |
| 6,435,277 | B1 | 8/2002 | Qu et al. | |
| 6,506,710 | B1 | 1/2003 | Hoey et al. | |
| 6,559,245 | B2 | 5/2003 | Mao et al. | |
| 6,605,570 | B2 * | 8/2003 | Miller et al. | 507/211 |
| 6,703,352 | B2 | 3/2004 | Dahayanake et al. | |
| 7,060,661 | B2 | 6/2006 | Dobson et al. | |
| 7,114,567 | B2 | 10/2006 | Chan et al. | |
| 7,294,347 | B2 | 11/2007 | Menjoge et al. | |
| 7,303,018 | B2 | 12/2007 | Cawiezel et al. | |
| 7,510,009 | B2 | 3/2009 | Cawiezel et al. | |
| 7,784,541 | B2 | 8/2010 | Hartman et al. | |
| 2008/0000638 | A1 | 1/2008 | Burukhin et al. | |
| 2008/0280788 | A1 | 11/2008 | Parris et al. | |
| 2008/0280790 | A1 | 11/2008 | Mirakyan et al. | |
| 2009/0025932 | A1 * | 1/2009 | Panga et al. | 166/278 |
| 2009/0025934 | A1 * | 1/2009 | Hartman et al. | 166/280.2 |
| 2010/0243250 | A1 | 9/2010 | Panga et al. | |
| 2012/0111563 | A1 | 5/2012 | Abad et al. | |
| 2012/0125617 | A1 * | 5/2012 | Gu et al. | 166/308.1 |

FOREIGN PATENT DOCUMENTS

WO 2009088317 7/2009

OTHER PUBLICATIONS

International Search Report and Written Opinion issued in PCT/US2011/059081 on Mar. 20, 2012, 15 pages.

* cited by examiner

*Primary Examiner* — George Suchfield
(74) *Attorney, Agent, or Firm* — Matthieu Vandermolen; Daryl Wright; Tim Curington

(57) ABSTRACT

The invention discloses a method of treating a subterranean formation of a well bore, including the steps of providing a first treatment fluid substantially free of macroscopic particulates; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74; subsequently, pumping the second treatment fluid below the minimum frac rate; and allowing the particulates to migrate into the fracture.

29 Claims, 1 Drawing Sheet

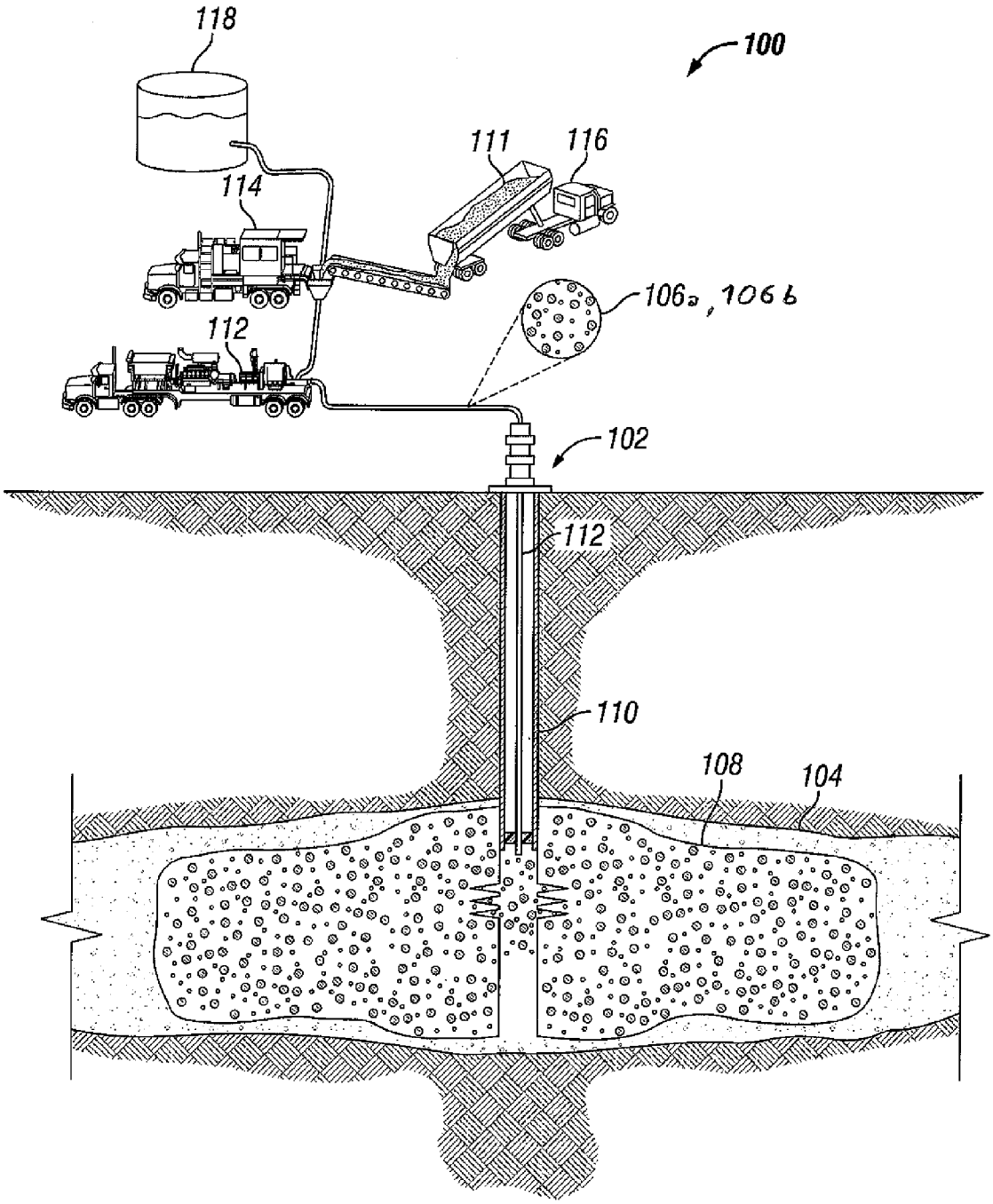
118
100
111
116
114
106a, 106b
112
102
112
110
108
104

METHODS TO ENHANCE THE PRODUCTIVITY OF A WELL

FIELD OF THE INVENTION

The invention relates to methods for treating subterranean formations. More particularly, the invention relates to methods for proppant based stimulation treatment at predefined pressure through a prior fracture stimulation treatment.

BACKGROUND

The statements in this section merely provide background information related to the present disclosure and may not constitute prior art.

Hydrocarbons (oil, condensate, and gas) are typically produced from wells that are drilled into the formations containing them. For a variety of reasons, such as inherently low permeability of the reservoirs or damage to the formation caused by drilling and completion of the well, the flow of hydrocarbons into the well is undesirably low. In this case, the well is "stimulated" for example using hydraulic fracturing, chemical (usually acid) stimulation, or a combination of the two (called acid fracturing or fracture acidizing).

Hydraulic Fracturing is a stimulation process commonly used in order to enhance hydrocarbon (oil and gas) productivity from the earth formations where these resources are accumulated. During hydraulic fracturing, a fluid is pumped at rates and pressures that cause the downhole rock to fracture. Typical stages of a fracturing treatment are the fracture initiation, fracture propagation and fracture closure. During fracture initiation fluids are pumped into a wellbore connected to the formation through entry points such as slots, or perforations, to create a typically biplanar fracture in the rock formation. During propagation, fluids are pumped to grow the fracture primarily in the longitudinal and vertical direction, for which fluids are pumped into the wellbore at rates exceeding the rate of fluid filtration into the formation, or fluid loss rate. Optimal fracturing fluids pumped to propagate fractures typically have rheological characteristics that promote a reduction of the fluid loss rate, and serve the purpose of maintaining a certain width of the created fracture at the rate and pressure at which the fluid is pumped downhole, what in return increases the efficiency of the treatment, defined as the volume of fracture created divided by the volume of fluid pumped. Upon cessation of flow, the downhole formation tends to close the fracture forcing the fluid in the fracture to further filtrate into the formation, and or into the wellbore.

In some treatments, know as acid fracturing treatments, in order to maintain some connectivity between the created fracture and the wellbore, acids are incorporated into the fluid (dissolved, or suspended) which are capable of etching some of the minerals in the formation faces, thus creating areas of misalignment through which hydrocarbons can flow into the wellbore from the formation.

In other treatments, known as propped fracturing treatments, solid particulates of sizes substantially bigger than the grains in the formation known as proppant, which are capable of substantially withstanding the closure stress, are pumped with the fluid in order to prevent complete fracture closure (prop the fracture open) and to create a conductive path for the hydrocarbons.

A few different methods of creating propped hydraulic fractures are known. Many treatments requiring a substantial width formation resort to the use of viscous fluids capable of reducing fluid loss, typically aqueous polymer or surfactant solutions, foams, gelled oils, and similar viscous liquids to initiate and propagate the fracture, and to transport the solids into the fracture. In these treatments the fluid flow rate is maintained at a relatively high pump rate, in order to continuously propagate the fracture and maintain the fracture width. A first fluid, known as pad, is pumped to initiate the fracture, which is pushed deeper into the reservoir by propagating the fracture, by the fluid pumped at later stages, known as slurry, which typically contains and transports the proppant particles. In general the viscosity of pad and slurry are similar, facilitating the homogeneous displacement of the pad fluid, without substantial fingering of one fluid into the other.

Recently a different method of creating propped fractures has been proposed in which a viscous fluid and a slurry fluid are alternated at a very high frequency, allowing for heterogeneous placement of proppant in the formation.

Another method of creating propped fractures very common in low permeability reservoirs where fluid viscosity is not typically required to reduce fluid loss is the use of high rate water fracs or slick water fracs. In these treatments, the low viscosity slurry is typically not able to substantially suspend the proppant, which sinks to the bottom of the fracture, and the treatment relies on the turbulent nature of the flow of a low viscosity fluid pumping at a very high velocity above the proppant to push the proppant deeper into the formation in a process called dunning, (because is similar to the dune formation in sandy areas, where the wind fluidizes the sand grains on the surface, and transports it for a short distance until they drop by gravity), creating a front that smoothly advances deeper and deeper into the fracture. In this case, proppant slugs are pumped, at very low proppant concentrations to prevent near wellbore deposition (screenout) followed by clean fluid slugs aiming to push the sand away from the wellbore.

Hybrid treatments where fractures are opened with one type of the fluids and propped with a different fluid can be envisioned and are also known, and practiced in the industry.

Matrix treatments are stimulation treatments in which a fluid capable of dissolving certain components naturally occurring in the formation, or deposited near the wellbore during drilling, cementing, or production is pumped into the formation at a rate and pressure substantially smaller that those required to initiate a fracture in the formation. Matrix treatments are typically pumped into formations in order to reduce the skin around the wellbore, restoring the natural conductivity of the formation, which is typically damaged by the drilling and cementing fluids that are used to complete the wellbore. Acids, and solvents, are typically pumped for this purpose. Generally solids are not pumped in these matrix treatments with the purpose of transporting them deep into the reservoir, since they would typically not travel far into the formation, due to the tortuous porous path resulting from these dissolving treatments. Instead, solids can be pumped in matrix treatments in order to divert near wellbore, the flow of fluid from given zones of the reservoir towards others.

It is a purpose to disclose a new method of propping at matrix rate through a prior fracture stimulation treatment.

SUMMARY

In a first aspect, a method of treating a subterranean formation of a well bore is disclosed. The method includes the steps of providing a first treatment fluid substantially free of macroscopic particulates; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74; subsequently, pumping the second treatment fluid below the minimum frac rate; and allowing the particulates to migrate into the fracture.

In a second aspect, a method of fracturing a subterranean formation of a well bore is disclosed. The method includes the steps of providing a first treatment fluid substantially free of macroscopic particulates and comprising a first carrier fluid, and a first viscosifying agent; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; stopping to pump the first treatment fluid; determining the rate of fluid loss into the subterranean formation; if rate of fluid loss is lower than a predetermined value, allowing the first treatment fluid to filtrate into the subterranean formation and the fracture to substantially close; reinitiate pumping of the first treatment fluid above the maximum matrix rate and below the minimum frac rate; providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74; subsequently, pumping the second treatment fluid below the minimum frac rate; allowing the particulates to migrate into the fracture; stopping to pump the second treatment fluid; and allowing in the fracture, the subterranean formation to close upon the particulates.

BRIEF DESCRIPTION OF THE DRAWINGS

FIG. 1 shows an illustration of some embodiments.

DETAILED DESCRIPTION

At the outset, it should be noted that in the development of any actual embodiments, numerous implementation-specific decisions must be made to achieve the developer's specific goals, such as compliance with system and business related constraints, which can vary from one implementation to another. Moreover, it will be appreciated that such a development effort might be complex and time consuming but would nevertheless be a routine undertaking for those of ordinary skill in the art having the benefit of this disclosure.

The description and examples are presented solely for the purpose of illustrating embodiments of the invention and should not be construed as a limitation to the scope and applicability of the invention. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possession of the entire range and all points within the range disclosed and enabled the entire range and all points within the range.

The following definitions are provided in order to aid those skilled in the art in understanding the detailed description.

The term "treatment", or "treating", refers to any subterranean operation that uses a fluid in conjunction with a desired function and/or for a desired purpose. The term "treatment", or "treating", does not imply any particular action by the fluid.

The term "fracturing" refers to the process and methods of breaking down a geological formation and creating a fracture, i.e. the rock formation around a well bore, by pumping fluid at very high pressures, in order to increase production rates from a hydrocarbon reservoir. The fracturing methods otherwise use conventional techniques known in the art.

FIG. 1 is a schematic diagram of a system 100 used in a method to enhance the productivity of a well. The system 100 includes a wellbore 102 in fluid communication with a subterranean formation of interest 104. The formation of interest 104 may be any formation wherein fluid communication between a wellbore and the formation is desirable, including a hydrocarbon-bearing formation, a water-bearing formation, a formation that accepts injected fluid for disposal, pressurization, or other purposes, or any other formation understood in the art.

The system 100 further includes a first treatment fluid **106*a* that includes a fluid having optionally a low amount of a viscosifier and a second treatment fluid 106*b* that includes a second carrier fluid, a particulate blend including a first amount of particulates and a second amount of particulates. The first treatment fluid can be embodied as a fracturing slurry wherein the fluid is a first carrier fluid. The first or second carrier fluid includes any base fracturing fluid understood in the art. Some non-limiting examples of carrier fluids include hydratable gels (e.g. guars, poly-saccharides, xanthan, hydroxy-ethyl-cellulose, etc.), a cross-linked hydratable gel, a viscosified acid (e.g. gel-based), an emulsified acid (e.g. oil outer phase), an energized fluid (e.g. an $N_2$or $CO_2$based foam), and an oil-based fluid including a gelled, foamed, or otherwise viscosified oil. Additionally, the first or second carrier fluid may be a brine, and/or may include a brine. Also the first or second carrier fluid may be a gas. While the second treatment fluid 106*b* described herein includes particulates, the system 100** may further include certain stages of fracturing fluids with alternate mixtures of particulates.

The first or the second treatment fluid may further include a low amount of viscosifier. By low amount of viscosifier, it is meant a lower amount of viscosifier than conventionally is included for a fracture treatment. The loading of the viscosifier, for example described in pounds of gel per 1,000 gallons of carrier fluid, is selected according optionally to the particulate size (due to settling rate effects) and loading that the fracturing slurry must carry, according to the viscosity required to generate a desired fracture 108 geometry, according to the pumping rate and casing 110 or tubing 112 configuration of the wellbore 102, according to the temperature of the formation of interest 104, and according to other factors understood in the art. In certain embodiments, the low amount of the viscosifier includes a hydratable gelling agent in the carrier fluid at less than 20 pounds per 1,000 gallons of carrier fluid where the amount of particulates in the fracturing slurry are greater than 16 pounds per gallon of carrier fluid. In certain further embodiments, the low amount of the viscosifier includes a hydratable gelling agent in the carrier fluid at less than 20 pounds per 1,000 gallons of carrier fluid where the amount of particulates in the fracturing slurry are greater than 23 pounds per gallon of carrier fluid. In certain embodiments, a low amount of the viscosifier includes a visco-elastic surfactant at a concentration below 1% by volume of carrier fluid. In certain embodiments a low amount of the viscosifier includes values greater than the listed examples, because the circumstances of the system 100 conventionally utilize viscosifier amounts much greater than the examples. For example, in a high temperature application with a high proppant loading, the carrier fluid may conventionally indicate the viscosifier at 50 lbs of gelling agent per 1,000 gallons of carrier fluid, wherein 40 lbs of gelling agent, for example, may be a low amount of viscosifier. One of skill in the art can perform routine tests of treatment fluids 106*a* or 106*b* based on certain particulate blends 111 in light of the disclosures herein to determine acceptable viscosifier amounts for a particular embodiment of the system 100.

The system 100 includes a first treatment fluid that is substantially free of macroscopic particulates i.e. without particulates or with alternate mixtures of particulates. For example, the first treatment fluid may be a pad fluid and/or a flush fluid in certain embodiments. In certain embodiments, the pad fluid is free of macroscopic particulates, but may also include microscopic particulates or other additives such as fluid loss additives, breakers, or other materials known in the art.

The system 100 includes a second treatment fluid which includes particulate materials generally called proppant. Proppant involves many compromises imposed by economical and practical considerations. Criteria for selecting the proppant type, size, and concentration is based on the needed dimensionless conductivity, and can be selected by a skilled artisan. Such proppants can be natural or synthetic (including but not limited to glass beads, ceramic beads, sand, and bauxite), coated, or contain chemicals; more than one can be used sequentially or in mixtures of different sizes or different materials. The proppant may be resin coated, or pre-cured resin coated. Proppants and gravels in the same or different wells or treatments can be the same material and/or the same size as one another and the term proppant is intended to include gravel in this disclosure. In general the proppant used will have an average particle size of from about 0.15 mm to about 2.39 mm (about 8 to about 100 U.S. mesh), more particularly, but not limited to 0.25 to 0.43 mm (40/60 mesh), 0.43 to 0.84 mm (20/40 mesh), 0.84 to 1.19 mm (16/20), 0.84 to 1.68 mm (12/20 mesh) and 0.84 to 2.39 mm (8/20 mesh) sized materials. Normally the proppant will be present in the slurry in a concentration of from about 0.12 to about 0.96 kg/L, or from about 0.12 to about 0.72 kg/L, or from about 0.12 to about 0.54 kg/L.

In one embodiment, the second treatment fluid 106*b* comprises particulate materials with defined particles size distribution. On example of realization is disclosed in U.S. Pat. No. 7,784,541, herewith incorporated by reference.

The second treatment fluid 106*b* includes a first amount of particulates having a first average particle size between about 100 and 2000 μm. In certain embodiments, the first amount of particulates may be a proppant, for example sand, ceramic, or other particles understood in the art to hold a fracture 108 open after a treatment is completed. In certain embodiments, the first amount of particulates may be a fluid loss agent, for example calcium carbonate particles or other fluid loss agents known in the art. In certain embodiments, the first amount of particulates may be a degradable particulate, for example PLA particles or other degradable particulates known in the art. In certain embodiments, the first amount of particulates may be a chemical for example as viscosity breakers, corrosion inhibitors, inorganic scale inhibitors, organic scale inhibitors, gas hydrate control, wax, asphaltene control agents, catalysts, clay control agents, biocides, friction reducers and mixture thereof.

The second treatment fluid 106*b* further includes a second amount of particulates having a second average particle size between about three times and about ten, fifteen or twenty times smaller than the first average particle size. For example, where the first average particle size is about 100 μm (an average particle diameter, for example), the second average particle size may be between about 5 μm and about 33 μm. In certain preferred embodiments, the second average particle size may be between about seven and ten times smaller than the first average particle size. In certain embodiments, the second amount of particulates may be a fluid loss agent, for example calcium carbonate particles or other fluid loss agents known in the art. In certain embodiments, the second amount of particulates may be a degradable particulate, for example PLA particles or other degradable particulates known in the art. In certain embodiments, the second amount of particulates may be a chemical for example as viscosity breakers, corrosion inhibitors, inorganic scale inhibitors, organic scale inhibitors, gas hydrate control, wax, asphaltene control agents, catalysts, clay control agents, biocides, friction reducers and mixture thereof.

In certain embodiments, the selection of the size for the first amount of particulates is dependent upon the characteristics of the propped fracture 108, for example the closure stress of the fracture, the desired conductivity, the size of fines or sand that may migrate from the formation, and other considerations understood in the art. In certain further embodiments, the selection of the size for the first amount of particulates is dependent upon the desired fluid loss characteristics of the first amount of particulates as a fluid loss agent, the size of pores in the formation, and/or the commercially available sizes of particulates of the type comprising the first amount of particulates.

In certain embodiments, the selection of the size of the second amount of particulates is dependent upon maximizing a packed volume fraction (PVF) of the mixture of the first amount of particulates and the second amount of particulates. The packed volume fraction or packing volume fraction (PVF) is the fraction of solid content volume to the total volume content. A second average particle size of between about seven to ten times smaller than the first amount of particulates contributes to maximizing the PVF of the mixture, but a size between about three to twenty times smaller, and in certain embodiments between about three to fifteen times smaller, and in certain embodiments between about three to ten times smaller will provide a sufficient PVF for most systems 100. Further, the selection of the size of the second amount of particulates is dependent upon the composition and commercial availability of particulates of the type comprising the second amount of particulates. For example, where the second amount of particulates comprise wax beads, a second average particle size of four times (4×) smaller than the first average particle size rather than seven times (7×) smaller than the first average particle size may be used if the 4× embodiment is cheaper or more readily available and the PVF of the mixture is still sufficient to acceptably suspend the particulates in the carrier fluid. In certain embodiments, the particulates combine to have a PVF above 0.74 or 0.75 or above 0.80. In certain further embodiments the particulates may have a much higher PVF approaching 0.95.

In certain embodiments, the second treatment fluid 106*b* further includes a third amount of particulates having a third average particle size that is smaller than the second average particle size. In certain further embodiments, the second treatment fluid 106*b* may have a fourth or a fifth amount of particles. For the purposes of enhancing the PVF of the second treatment fluid 106*b*, more than three or four particles sizes will not typically be required. For example, a four-particle blend including 217 g of 20/40 mesh sand, 16 g or poly-lactic acid particles with an average size of 150 microns, 24 g of poly-lactic acid particles with an average size of 8 microns, and 53 g of $CaCO_3$particles with an average size of 5 microns creates a particulate blend 111 having a PVF of about 0.863. In a second example, a three-particle blend wherein each particle size is 7× to 10× smaller than the next larger particle size creates a particulate blend 111 having a PVF of about 0.95. However, additional particles may be added for other reasons, such as the chemical composition of the additional particles, the ease of manufacturing certain materials into the same particles versus into separate particles, the commercial availability of particles having certain properties, and other reasons understood in the art.

In certain embodiments, the system 100 includes a pumping device 112 structured to create a fracture 108 in the formation of interest 104 with the first treatment fluid 106*a*. The system 100 in certain embodiments further includes peripheral devices such as a blender 114, a particulates hauler 116, fluid storage tank(s) 118, and other devices understood in the art. In certain embodiments, the carrier fluid may be stored in the fluid storage tank 118, or may be a fluid created by mixing additives with a base fluid in the fluid storage tank 118 to create the carrier fluid. The particulates may be added from a conveyor 120 at the blender 114, may be added by the blender 114, and/or may be added by other devices (not shown). In certain embodiments, one or more sizes of particulates may be pre-mixed into the particulate blend 111. For example, if the second treatment fluid 106*b* includes a first amount, second amount, and third amount of particulates, a particulate blend 111 may be premixed and include the first amount, second amount, and third amount of particulates. In certain embodiments, one or more particulate sizes may be added at the blender 114 or other device. For example, if the second treatment fluid 106*b* includes a first amount, second amount, and third amount of particulates, a particulate blend 111 may be premixed and include the first amount and second amount of particulates, with the third amount of particulates added at the blender 114. In some cases the particle blend could be added from a liquid transport container in a pumpable slurry form as disclosed in pending patent application Ser. No. 12/941,192 incorporated herewith by reference.

In certain embodiments, the first or second treatment fluid includes a degradable material. In certain embodiments for the second treatment fluid 106*b*, the degradable material is making up at least part of the second amount of particulates. For example, the second amount of particulates may be completely made from degradable material, and after the fracture treatment the second amount of particulates degrades and flows from the fracture 108 in a fluid phase. In another example, the second amount of particulates includes a portion that is degradable material, and after the fracture treatment the degradable material degrades and the particles break up into particles small enough to flow from the fracture 108. In certain embodiments, the second amount of particulates exits the fracture by dissolution into a fluid phase or by dissolution into small particles and flowing out of the fracture.

In certain embodiments, the degradable material includes at least one of a lactide, a glycolide, an aliphatic polyester, a poly (lactide), a poly (glycolide), a poly (ϵ-caprolactone), a poly (orthoester), a poly (hydroxybutyrate), an aliphatic polycarbonate, a poly (phosphazene), and a poly (anhydride). In certain embodiments, the degradable material includes at least one of a poly (saccharide), dextran, cellulose, chitin, chitosan, a protein, a poly (amino acid), a poly (ethylene oxide), and a copolymer including poly (lactic acid) and poly (glycolic acid). In certain embodiments, the degradable material includes a copolymer including a first moiety which includes at least one functional group from a hydroxyl group, a carboxylic acid group, and a hydrocarboxylic acid group, the copolymer further including a second moiety comprising at least one of glycolic acid and lactic acid.

In certain embodiments, the carrier fluid includes an acid. The fracture 108 is illustrated as a traditional hydraulic double-wing fracture, but in certain embodiments may be an etched fracture and/or wormholes such as developed by an acid treatment. The carrier fluid may include hydrochloric acid, hydrofluoric acid, ammonium bifluoride, formic acid, acetic acid, lactic acid, glycolic acid, maleic acid, tartaric acid, sulfamic acid, malic acid, citric acid, methyl-sulfamic acid, chloro-acetic acid, an amino-poly-carboxylic acid, 3-hydroxypropionic acid, a poly-amino-poly-carboxylic acid, and/or a salt of any acid. In certain embodiments, the carrier fluid includes a poly-amino-poly-carboxylic acid, and is a trisodium hydroxyl-ethyl-ethylene-diamine triacetate, mono-ammonium salts of hydroxyl-ethyl-ethylene-diamine triacetate, and/or mono-sodium salts of hydroxyl-ethyl-ethylene-diamine tetra-acetate. The selection of any acid as a carrier fluid depends upon the purpose of the acid—for example formation etching, damage cleanup, removal of acid-reactive particles, etc., and further upon compatibility with the formation 104, compatibility with fluids in the formation, and compatibility with other components of the fracturing slurry and with spacer fluids or other fluids that may be present in the wellbore 102.

In some embodiments, the first or second treatment fluid may optionally further comprise additional additives, including, but not limited to, acids, fluid loss control additives, gas, corrosion inhibitors, scale inhibitors, catalysts, clay control agents, biocides, friction reducers, combinations thereof and the like. For example, in some embodiments, it may be desired to foam the first or second treatment fluid using a gas, such as air, nitrogen, or carbon dioxide. In one certain embodiment, the second treatment fluid may contain a particulate additive, such as a particulate scale inhibitor.

In an exemplary embodiment, a method of treating the subterranean formation of the well bore includes: providing the first treatment fluid substantially free of macroscopic particulates; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; providing the second treatment fluid; subsequently, pumping the second treatment fluid below the minimum frac rate; and allowing the particulates to migrate into the fracture. By maximum matrix rate, it is meant the maximum pressure rate allowed to not damage the subterranean formation i.e. create a fracture. By minimum frac rate, it is meant the minimum pressure rate required to initiate a fracture in the subterranean formation.

In another exemplary embodiment a method of treating the subterranean formation of the well bore includes: providing the first treatment fluid substantially free of macroscopic particulates; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; stopping to pump the first treatment fluid; determining the rate of fluid loss into the subterranean formation; providing the second treatment fluid; subsequently, pumping the second treatment fluid below the minimum frac rate; and allowing the particulates to migrate into the fracture. By maximum matrix rate, it is meant the maximum pressure rate allowed to not damage the subterranean formation i.e. create a fracture.

In another exemplary embodiment a method of treating the subterranean formation of the well bore includes: providing the first treatment fluid substantially free of macroscopic particulates; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; stopping to pump the first treatment fluid; determining the rate of fluid loss into the subterranean formation; if rate of fluid loss is lower than a predetermined value, allowing the first treatment fluid to filtrate into the subterranean formation and the fracture to substantially close; reinitiate pumping of the first treatment fluid above the maximum matrix rate and below the minimum frac rate; providing the second treatment fluid; subsequently, pumping the second treatment fluid below the minimum frac rate; and allowing the particulates to migrate into the fracture. By maximum matrix rate, it is meant the maximum pressure rate allowed to not damage the subterranean formation i.e. create a fracture.

In another exemplary embodiment a method of treating the subterranean formation of the well bore includes: providing the first treatment fluid substantially free of macroscopic particulates; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; stopping to pump the first treatment fluid; allowing the first treatment fluid to filtrate into the subterranean formation and the fracture to substantially close; reinitiate pumping of the first treatment fluid above the maximum matrix rate and below the minimum frac rate; providing the second treatment fluid; subsequently, pumping the second treatment fluid below the minimum frac rate; and allowing the particulates to migrate into the fracture. By maximum matrix rate, it is meant the maximum pressure rate allowed to not damage the subterranean formation i.e. create a fracture.

In an exemplary embodiment, a method of treating the subterranean formation of the well bore includes: providing the first treatment fluid substantially free of macroscopic particulates; pumping the first treatment fluid into the well bore at different pressure rates to determine the maximum matrix rate and the minimum frac rate; subsequently, pumping the first treatment fluid above the minimum frac rate to initiate at least one fracture in the subterranean formation; providing the second treatment fluid; subsequently, pumping the second treatment fluid below the minimum frac rate; allowing the particulates to migrate into the fracture; stopping to pump the second treatment fluid; and allowing in the fracture, the subterranean formation to close upon the particulates.

In other embodiments, the method includes the second treatment to stop, the first treatment to initiate subsequently, the first treatment is stopped and subsequently the second treatment is initiated again. Also the second treatment and first treatment can be pumped alternatively in multiple cycles.

In some embodiments, the first treatment fluid and the second treatment fluid interact, for example the viscosity of the second treatment fluid may increase by migration of some components into the first treatment fluid; also for example diversion of the first treatment fluid may be realized.

In some embodiment, a substantial amount of the particulates dissolve in contact with the first treatment fluid in the fracture. In some embodiment, a substantial amount of the particulates break upon closure of the fracture. In some embodiment a substantial amount of the particulates burst in contact with the first treatment fluid in the fracture. In some embodiment a substantial amount of the particulates slowly dissolve releasing chemicals required to provide a certain functionality to the fracture. Examples of said chemicals are breakers for the viscous fluid, clay control chemicals, inorganic and or organic scale control chemicals, gas hydrate control, wax, or asphaltene control chemicals, and the like.

In some embodiment, at least a fraction of the particulates can be used as tracers by recognition of their nature from the wellbore or from the surface, by means of electromagnetic, or pressure wave signals, or by recognition of a fraction of the material these particulates are made of by chemical or physical means.

By this way, recognizing of the entry point of a specific element of the second treatment fluid during pumping or recognizing of the location of a specific element of the second treatment fluid upon closure may be realized.

The treatments disclosed herewith can be combined with other known techniques for example: with wireline deployed tool or coil tubing deployed tool capable of determining flow, temperature, or an electrostatic, or pressure wave signal is present in the wellbore.

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention.

What is claimed is:

1. A method of treating a subterranean formation of a well bore, comprising:

a. providing a first treatment fluid substantially free of macroscopic particulates;

b. pumping the first treatment fluid into the well bore at different pressure rates to determine the maximum matrix rate and the minimum frac rate;

c. subsequently, pumping the first treatment fluid above the minimum frac rate to initiate at least one fracture in the subterranean formation;

d. providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74;

e. subsequently, pumping the second treatment fluid below the minimum frac rate; and f. allowing the particulates to migrate into the fracture.

2. The method of claim 1, wherein the first treatment fluid comprises a first carrier fluid, and a first viscosifying agent.

3. The method of claim 2, wherein the viscosifying agent includes a member selected from the list consisting of a hydratable gelling agent at less than 20 lbs per 1,000 gallons of first carrier fluid, and a viscoelastic surfactant at a concentration less than 1% by volume of first carrier fluid.

4. The method of claim 1, further comprising the steps:

g. subsequently after step c, stopping to pump the first treatment fluid; and h. determining the rate of fluid loss into the subterranean formation.

5. The method of claim 4, further comprising the steps:

i. subsequently after step h, if rate of fluid loss is lower than a predetermined value, allowing the first treatment fluid to filtrate into the subterranean formation and the fracture to substantially close; and j. reinitiate pumping of the first treatment fluid above the maximum matrix rate and below the minimum frac rate.

6. The method of claim 1, further comprising the steps:

k. subsequently after step c, allowing the first treatment fluid to filtrate into the subterranean formation and the fracture to substantially close; and l. reinitiate pumping of the first treatment fluid above the maximum matrix rate and below the minimum frac rate.

7. The method of claim 1, further comprising the steps:

m. subsequently after step f, stopping to pump the second treatment fluid; and n. allowing in the fracture, the subterranean formation to close upon the particulates.

8. The method of claim 1, further comprising the steps of alternatively pumping the first treatment fluid and the second treatment fluid into the well bore.

9. The method of claim 1, further comprising the steps of pumping the first treatment fluid into the well bore, stopping to pump the first treatment fluid; and pumping the second treatment fluid into the well bore, and stopping to pump the second treatment fluid.

10. The method of claim 1, wherein the first treatment fluid and the second treatment fluid interact.

11. The method of claim 10 wherein the interaction allows the viscosity of the second treatment fluid to increase.

12. The method of claim 1, wherein the second carrier fluid further includes a second viscosifying agent.

13. The method of claim 12, wherein the viscosifying agent includes a member selected from the list consisting of a hydratable gelling agent at less than 20 lbs per 1,000 gallons of second carrier fluid, and a viscoelastic surfactant at a concentration less than 1% by volume of second carrier fluid.

14. The method of claim 1, wherein the second amount of particulates comprises one of a proppant, a fluid loss additive and a degradable material.

15. The method of claim 1, wherein the second treatment fluid further comprises a degradable particulate material.

16. The method of claim 1, wherein the first amount of particulates comprise one of a proppant, a fluid loss additive and a degradable material.

17. The method of claim 1, wherein the packed volume fraction of the particulate blend exceeds 0.8.

18. The method of claim 1, wherein the second carrier fluid is a gas.

19. The method of claim 1, wherein the first amount of particulates is a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

20. The method of claim 1, wherein the second amount of particulates is a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

21. The method of claim 1, wherein the first treatment fluid further comprises a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

22. The method of claim 1, wherein the second treatment fluid further comprises a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

23. The method of claim 1, wherein the particulate blend further includes a third amount of particulates having a third average particulate size that is smaller than the second average particulate size.

24. The method of claim 23, wherein at least one of the second and third amount of particulates comprises a degradable material.

25. A method of fracturing a subterranean formation of a well bore, comprising:

a. providing a first treatment fluid substantially free of macroscopic particulates;

b. pumping the first treatment fluid into the well bore at different pressure rates to determine the maximum matrix rate and the minimum frac rate;

c. subsequently, pumping the first treatment fluid above the minimum frac rate to initiate at least one fracture in the subterranean formation;

d. providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74;

e. subsequently, pumping the second treatment fluid below the minimum frac rate;

f. allowing the particulates to migrate into the fracture;

g. stopping to pump the second treatment fluid; and h. allowing in the fracture, the subterranean formation to close upon the particulates.

26. The method of claim 25, further comprising the steps:

i. subsequently after step c, stopping to pump the first treatment fluid; and j. determining the rate of fluid loss into the subterranean formation.

27. The method of claim 26, further comprising the steps:

k. subsequently after step j, if rate of fluid loss is lower than a predetermined value, allowing the first treatment fluid to filtrate into the subterranean formation and the fracture to substantially close; and l. reinitiate pumping of the first treatment fluid above the maximum matrix rate and below the minimum frac rate.

28. The method of claim 25, further comprising the steps:

m. subsequently after step c, allowing the first treatment fluid to filtrate into the subterranean formation and the fracture to substantially close; and n. reinitiate pumping of the first treatment fluid above the maximum matrix rate and below the minimum frac rate.

29. A method of fracturing a subterranean formation of a well bore, comprising:

a. providing a first treatment fluid substantially free of macroscopic particulates and comprising a first carrier fluid, and a first viscosifying agent;

b. pumping the first treatment fluid into the well bore at different pressure rates to determine the maximum matrix rate and the minimum frac rate;

c. subsequently, pumping the first treatment fluid above the minimum frac rate to initiate at least one fracture in the subterranean formation;

d. stopping to pump the first treatment fluid;

e. determining the rate of fluid loss into the subterranean formation;

f. if rate of fluid loss is lower than a predetermined value, allowing the first treatment fluid to filtrate into the subterranean formation and the fracture to substantially close;

g. allowing the first treatment fluid to filtrate into the subterranean formation and the fracture to substantially close;

h. reinitiate pumping of the first treatment fluid above the maximum matrix rate and below the minimum frac rate;

i. providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74;

j. subsequently, pumping the second treatment fluid below the minimum frac rate;

k. allowing the particulates to migrate into the fracture;

l. stopping to pump the second treatment fluid; and m. allowing in the fracture, the subterranean formation to close upon the particulates.

* * * * *